United States Patent [19]

Vitunac

[11] Patent Number: 4,637,557

[45] Date of Patent: Jan. 20, 1987

[54] DEVICE FOR CLEANING THE SIZING SCREEN OF A MATERIAL REDUCTION APPARATUS

[76] Inventor: Edward A. Vitunac, 1618 Powers Run Rd., Pittsburgh, Pa. 15238

[21] Appl. No.: 754,708

[22] Filed: Jul. 15, 1985

[51] Int. Cl.[4] ..... B02C 13/284

[52] U.S. Cl. ..... 241/73; 209/384; 241/166

[58] Field of Search ..... 209/379, 384, 387, 388; 210/413; 15/246; 241/73, 166, 167

[56] References Cited

U.S. PATENT DOCUMENTS

| | | | |
|---|---|---|---|
| 1,606,505 | 11/1926 | Bury | 241/166 X |
| 2,672,985 | 3/1954 | Nordell | 241/166 X |
| 3,856,216 | 12/1974 | Teague et al. | 241/166 X |
| 4,421,642 | 12/1983 | Kreitner et al. | 241/166 X |

FOREIGN PATENT DOCUMENTS

| | | | |
|---|---|---|---|
| 2900096 | 7/1979 | Fed. Rep. of Germany | 241/166 |

*Primary Examiner*—Mark Rosenbaum

*Attorney, Agent, or Firm*—Robert D. Yeager; Christine R. Ethridge

[57] ABSTRACT

A cleaning device is provided for use with sizing screens in material reduction apparatus, such as crushers, pulverizers and shredders. The cleaning device automatically clears obstructions from the openings in a screen. The preferred embodiment of the cleaning device includes a rake connected to a carriage assembly. The carriage assembly includes a wheel and rail system. The tines of the rake extend upwards into the openings of the screen. When the wheels move along the rail, the rake tines travel along the openings in the screen, forcing any obstructing material into another portion of the material reduction apparatus. The rake is actuated manually, periodically at predetermined intervals or in response to a sensed reduction in flow.

8 Claims, 5 Drawing Figures

DEVICE FOR CLEANING THE SIZING SCREEN OF A MATERIAL REDUCTION APPARATUS

BACKGROUND OF THE INVENTION

1. Field of the Invention

The present invention relates to cleaning apparatus, and more particularly, to cleaning apparatus for use with crushing machines.

2. Description of the Prior Art

Coal, minerals and other mined, quarried or dredged organic and inorganic materials are often processed in size reduction machines, such as pulverizers, crushers or mills. Screens of a predetermined mesh are generally positioned upstream of the discharge end to permit only particles of a desired maximum size to pass. Depending upon the flow properties of the particular material, the size of the screen opening can reach a critical dimension, beyond which any further reduction in the size of the screen openings will cause the material to arch over the openings, thus blinding, or blocking the screen. Arching is caused generally by the increase in shear strength generated by interparticle friction, compaction, temperature or moisture build up. Blinding the screen leads to flow stoppage.

The problem is particularly acute when the material is exposed to weather. Coal, for example, will flow with minimal problems when dry; but, when wetted from rain, snow or process water, coal develops bonding strength sufficient to cause the coal to arch over 8 mesh screen. (2.36 millimeters, specified by the American Society of Testing Materials to achieve a maximum particle size). In addition, the natural moisture content of materials can contribute to increased shear strength and, consequently, arching.

A hammermill is the preferred material reduction machine for processing coal because it minimizes moisture loss. The natural moisture content of coal is an important parameter in assessing product quality.

In the coal industry, as well as in other organic and inorganic minerals industries, payments for material shipments in both domestic and international trade are determined by evaluating representative samples of the product. Because of the screen blinding that occurs, the samples evaluated are not truly representative, and the payments are, therefore, based on statistically incorrect representations of the contents of the entire tonnage sampled.

Several devices have been developed to clear openings in screens. Teague et al. U.S. Pat. No. 3,856,216 which issued on Dec. 24, 1974, discloses a mechanical rake oriented on the face of a bar grid for use in primary treatment of waste water. The automatic rake periodically sweeps along the entry side of the bar grids removing coarse solids which accumulate on the grid face as the waste water flows through it.

Botsch U.S. Pat. No. 4,184,957 which issued on Jan. 22, 1980, discloses a screening apparatus which includes a screen cleaner for removing coarse material from fluids. A dual screen arrangement is placed, one screen positioned behind the other, in the path of the fluid flow so that coarse materials within the fluid are retained on the face of the screens. The screen cleaner includes a motor driven cleaning carriage to which a rake is attached. The rake has a plurality of teeth which extend through the first screen and onto the face of the second screen. When the cleaning carriage is activated the rake moves upward along the screens stripping the entry sides of both screens of the particles deposited thereon.

Kreitner et al. U.S. Pat. No. 4,421,642 which issued on Dec. 20, 1983, discloses a device for clearing passages in the sieve plate of a wet comminuting machine. The sieve plate is used to separate the grinding medium within the comminuting machine from the milled suspension. The sieve plate has strips or holes through which the milled suspension flows, but which block the passage of the grinding medium. When the holes or slots in the sieve plate become blocked, a plate having sheet metal spikes or strips corresponding to the holes or slots is moved toward the sieve. As the sheet metal spikes or strips are pushed through the passages in the sieve plate, perpendicular to the holes or strips, the sieve is unclogged and further filtration can continue. The cleaning operation is repeated periodically, as required, and can be operated manually, pneumatically, hydraulically, or electrically.

Schoellhorn et al. U.S. Pat. No. 681,983, issued on Sept. 3, 1901; Shelton U.S. Pat. No. 1,670,748, issued on May 22, 1928; and Heinrich U.S. Pat. No. 3,587,983, issued on June 28, 1971, relate to cleaning mechanisms on rotary comminuting machines. The Schoellhorn patent discloses a pulverizer with a screen arrangement beneath the hammers of the comminutor. In order to prevent material from becoming lodged between the bars of the screen, the bars are caused to rock back and forth when the machine is in operation.

The Shelton Patent discloses a rotary crusher, or hammermill, which has an interior reciprocating impact plate. The reciprocating impact plate is designed to break up any crushed material which may become packed in a mass at the opening to the hammer circle. The packed mass reduces, and sometimes shuts off the feed to the machine.

The Heinrich Patent discloses a rotary crusher in which a baffle wall is periodically moved toward the crusher tools of the rotor by automatic controls to clear deposits which have collected on the baffle wall. The reciprocating and moving plates and walls described by the prior art references would not dislodge obstructions wedged in the openings of a sizing screen.

The object of the present invention is to provide a device for clearing arched material and other obstructions wedged in the openings in the screen of a material reduction machine. A further object is to provide such a clearing device which removes the obstructions from the discharge side of the screen, thus permitting the uninterrupted operation of the machine. A further object of the present invention is to provide such a parallel motion clearing device which can be easily added onto or incorporated into existing material reduction machines.

SUMMARY OF THE INVENTION

The present invention provides a device for cleaning a screen in a material processing apparatus wherein the screen has at least a plurality of elongate bars defining spaces therebetween through which material flows. The device is well suited for use in a material reduction apparatus, such as a hammermill, having a sizing screen through which sufficiently reduced material flows.

The device includes rake means or clearing means, having a plurality of members for clearing material blocking the spaces in the screen, a carriage assembly for moving or sweeping the rake means along the length of the elongate bars, and means for actuating the carriage assembly.

The members are preferably dimensioned to compliment the dimension of the spaces in such close tolerance to the elongate bars that the members clear material blocking the spaces when the carriage assembly is actuated without wearing the elongate bars to avoid damaging the bars or the members. The members may be tines but, may instead be brushes.

The carriage assembly may include at least one wheel operatively connected to the rake means, at least one path for guiding the wheel and means for so moving the wheel along the path that the rake means moves along the length of the elongate bars. There are preferably two wheels and two paths. The screen has opposing sides and each path is positioned on the opposing sides of the screen opposite each other. Each wheel is associated with a different one of the two paths. In this embodiment, the moving means, preferably fluid powered cylinders, are adapted to move the wheels along the paths in a manner which maintains the rake means in alignment with the screen. Other means may be provided to maintain the rake means in alignment with the screen.

The actuating means may selectively actuate the carriage assembly at predetermined intervals or in response to preselected stimuli, such as a reduction in material flow. It may also be manually actuated.

The rake means is preferably positioned adjacent to and downstream of the screen and the members preferably extend into and through the spaces between the bars of the screen.

BRIEF DESCRIPTION OF THE DRAWINGS

The present invention can be better understood by reference to the drawings in which.

DETAILED DESCRIPTION OF THE PREFERRED EMBODIMENT

FIGS. 2 through 5 illustrate the preferred embodiment of the cleaning device 10 in a hammermill 12. For purposes of the detailed description, the preferred embodiment of the cleaning device 10 is used in a hammermill, of the type shown in FIG. 1 to clear crushed coal, other organic or inorganic materials or other obstructions from the openings of a sizing screen. It should be appreciated however, that the cleaning device 10 can be used with any one of a number of material reduction machines which process a wide variety of organic and inorganic materials.

Figure 1:
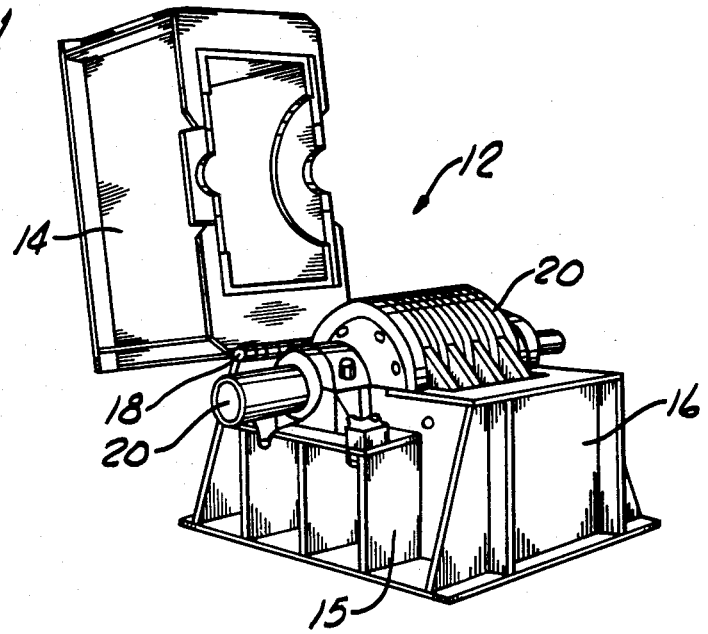
FIG. 1 is a perspective view of a conventional hammermill.

The hammermill 12 shown in FIG. 1 includes an upper housing 14 and a lower housing 16 attached by hinge 18 to permit quick inspection and easy access for maintenance. Pillow block supports 15 support a rotor and hammer assembly 20. In normal use, the upper housing 14 is closed.

Figure 4:
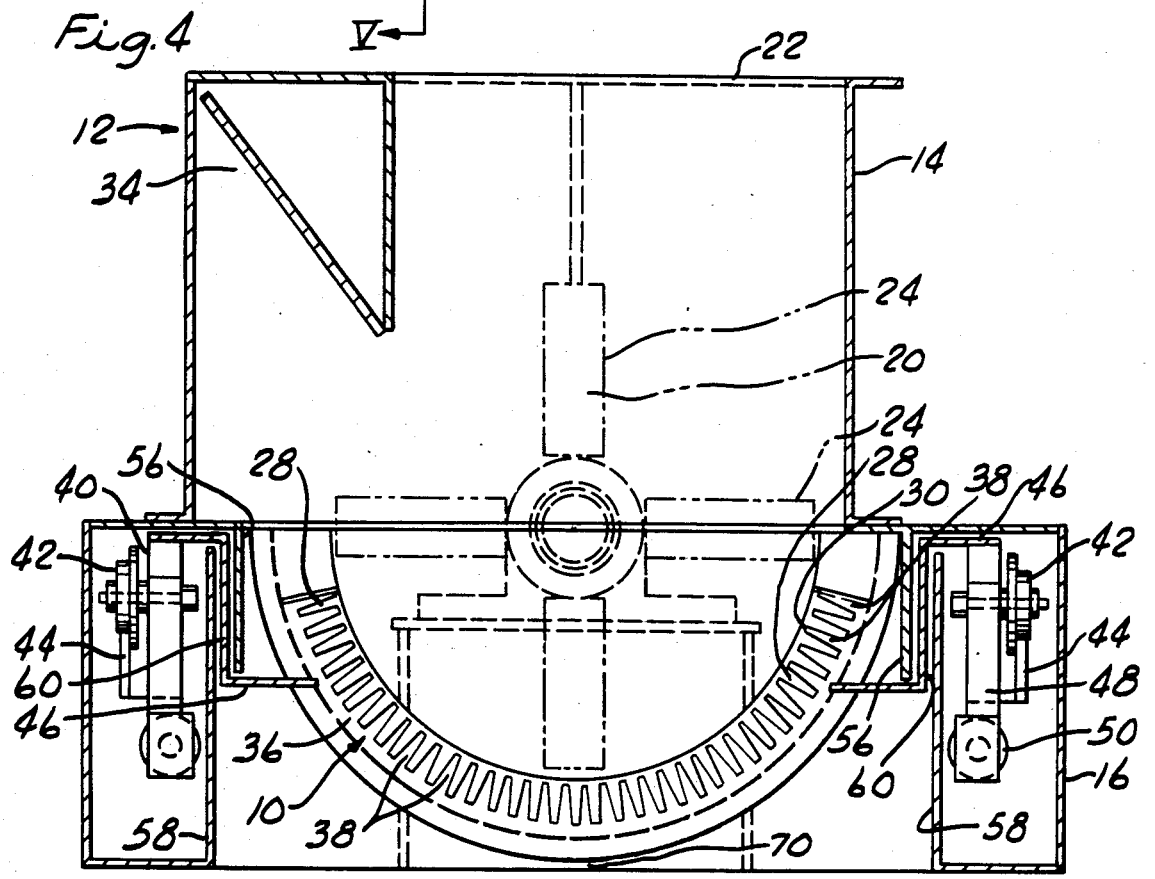
FIG. 4 is a section view of the hammermill and the clearing device taken along the line IV—IV of FIG. 3.

The rotor and hammer assembly 20 is employed to crush the coal. Referring to FIG. 4, coal to be reduced in size is introduced into the inlet 22 in upper housing 14. Hammers 24 of the rotor and hammer assembly 20 crush the coal to a size that will flow through openings 26 of a predetermined size in between the parallel elongate bars 28 of a sizing screen 30 positioned upstream of a discharge chute 70. Tramp material which will not pass through openings 26 is thrown by the rotating hammers 24 into the tramp chamber 34.

Figure 2:
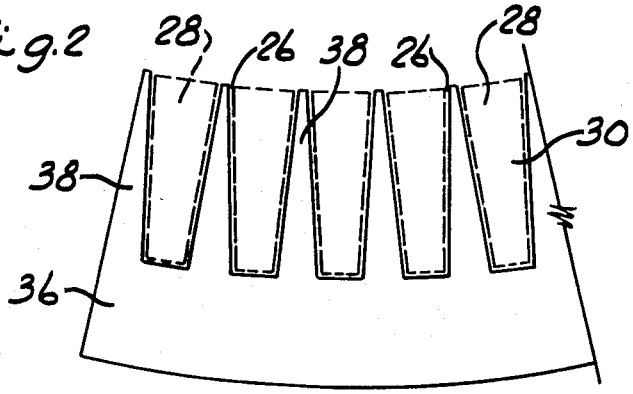
FIG. 2 is a partial section view of the clearing device of the present invention passing between the openings of a screen bar like that typically found in hammermills of the type shown in FIG. 1.

The cleaning device 10, as shown in FIGS. 2 and 4, includes a rake 36 having a plurality of tines 38 proportioned to extend into and slightly beyond the openings 26 between the screen bars 28 to approach the path of the hammers 24. There is a preferably a close tolerance between the surface of the screen bars 28 and the surface of the tines 38 to ensure that any obstruction blocking the openings 26 is dislodged.

Referring to FIG. 2, the dimensions of tines 38 of rake 36 compliment the dimensions of openings 26 defined by the adjacent screen bars 28. The sizing screen 30 is curved in cross-section. The rake 36, therefore, includes a complimentary curved structure. The rake can be made in any shape necessary to permit the tines 38 to compliment the shape of openings 26 in the sizing screen 30, or it may be noncomplimentary, provided the tines 38 are shaped to at least operatively compliment the openings 26 between screen bars 28.

The tines 38 are solid, rigid structures in the embodiment shown in FIGS. 2 and 4, but may be brushes or a similar, somewhat flexible structure which will effectively dislodge obstructions which blind the screen 30. In applications where the presence of moisture is not a concern, the tines 38 may include orifices through which fluid can be directed into the openings.

Figure 5:
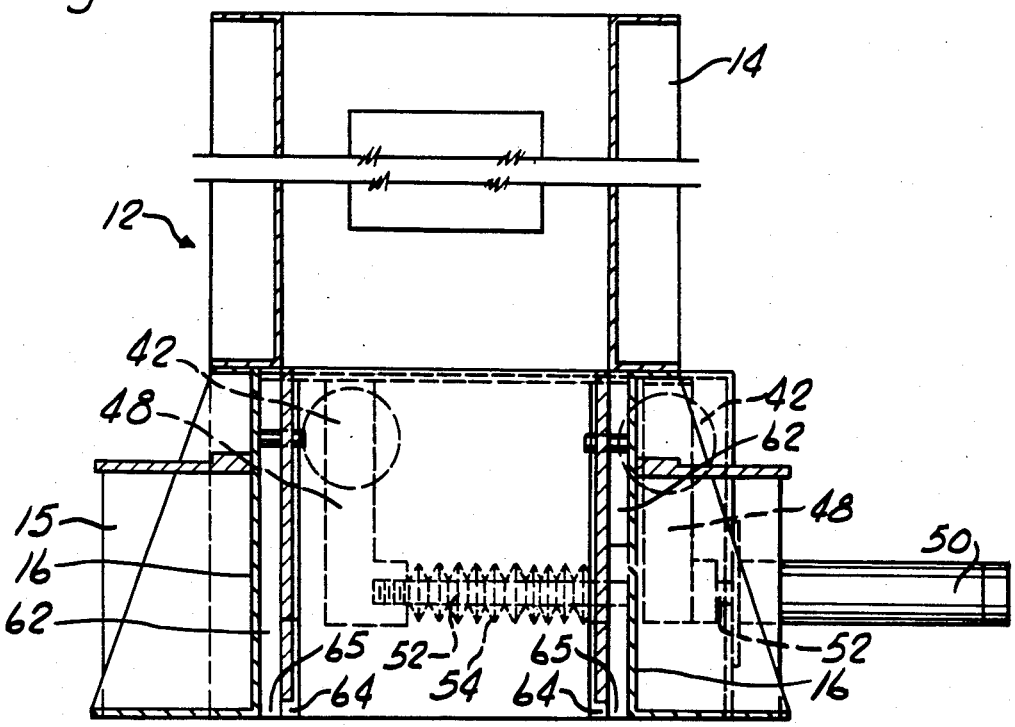
FIG. 5 is a section view of the hammermill and the clearing device taken along the line V—V of FIG. 3.

A carriage assembly 40 includes two wheels 42 which ride a path defined by rails 44. Each wheel 42 is attached to rake 36 by means of a drive plate 46. A drive arm 48 connects a wheel 42 to a cylinder 50 through a cylinder rod 52. A boot 54 shown in FIG. 5, is preferably placed over the cylinder rod 52 to prevent damage to the cylinder rod 52. Cylinders 50 can be hydraulic or pneumatic cylinders. Alternatively, any suitable known electrical or mechanical gearing system could be used to move wheels 42 along rails 44.

There are preferably two cylinders 50 and accompanying cylinder rods 52 and drive rods 48, one of each being associated with each wheel 42. The paired cylinders 50 provide matched drive actuation of rake 36 to prevent misalignment of rake 36 as it moves along sizing screen 30. Due to the close tolerance between the complimentary surfaces of tines 38 and screen bars 28, even a small misalignment can cause wedging or scraping, which in turn can damage or wear away the screen bars 28 and/or the tines 38.

Figure 3:
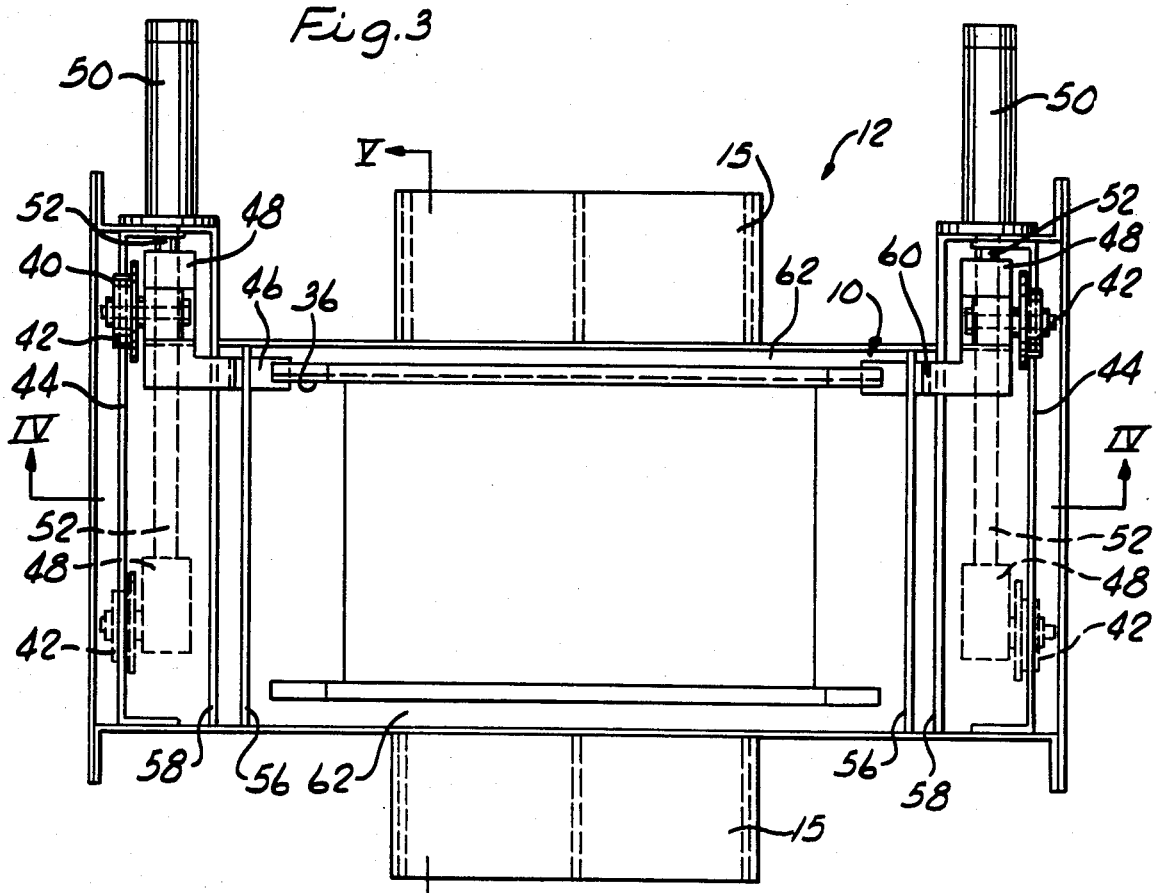
FIG. 3 is a top plan view of the preferred embodiment of the clearing device of the present invention showing the wheel and rail system in phantom to illustrate the range of motion.

Referring to FIG. 3, the rake 36, wheels 42 and drive arms 48 are shown in solid lines to illustrate one extreme of the range of rake movement. The phantom lines depict the wheels 42, drive arms 48 and cylinder arms 52 at the other extreme of the range of rake movement. FIG. 5 illustrates, in phantom, each extreme position of a wheel 42 and drive arm 48, showing the extension and retraction of the cylinder arm 52.

The carriage assembly 40 is shielded from damage or particulate build-up from the crushed coal by upper and lower seal walls, 56 and 58, respectively. FIGS. 3 and 4 illustrate an upper seal wall 56 positioned on the inside of each vertical wall 60 of opposing drive plates 46 between screen 30 and the carriage assembly 40. Lower seal wall 58 is positioned on the outside of each vertical 60 of opposing drive plates 46 between upper seal wall 56 and the carriage assembly 40. The seal walls 56 and 58 are spaced from the drive plate 46 at a minimum distance which permits ease of movement but prevents the passage of particles of crushed material from entering the carriage assembly. When material arches over the openings 26 between the screen bars 28, the flow of crushed material through the sizing screen 30 stops or at least, is reduced. A sensing device is preferably provided which monitors stimuli, such as the rate and/or amount of flow. A reduction in flow below a preselected level actuates the cylinders 50 which in turn actuate the movement of the rake 36 by means of carriage assembly 40. Any suitable sensing device can be used.

Alternatively, the cylinders 50 can be actuated at predetermined intervals. The intervals are determined on the basis of experience with a particular material and a particular material reducing machine. The cylinders 50 can also be actuated manually instead of, or in addition to, the automatic actuation described above. Any suitable known electronic or mechanical actuating control system will suffice. Whatever the actuation means employed, it should simultaneously actuate each cylinder 50 to provide the desired alignment.

In operation, the cylinder rods 52 extend from cylinders 50 and move the drive arms 48 forward. The drive arms 48 in turn move wheels 42 along rails 44. The drive plates 46 attached to each drive arm 48 move the rake 36 forward. Tines 38, which are prepositioned in openings 26, sweep through the openings 26 along the screen bars 28 dislodging any obstructions in their path. Reversing the sweeping motion is achieved by retracting cylinder rods 52. One or more sweeping motions may be sufficient to clear openings 26.

The dislodged obstructions are forced upwards into the path of the rotating hammers 24, are pushed through the openings 26 to discharge chute 70, or are discharged into passageways 62 defined by screen bar supports 64 on opposing sides of sizing screen 30 and lower housing 16. Material falling into passageways 62 can exit through outlets 65 so that it is segregated from the appropriately sized material passing through sizing screen 30 to discharge chute 70. The passageways 62 preferably increase in size toward the outlets 65.

The cleaning device 10 of the present invention, particularly when used with a suitable sensing device to actuate the cleaning device 10 as needed or at regular intervals, can dislodge arched materials and other obstructions from the sizing screen 30 quickly and efficiently to yield reduced-size product samples which accurately represents the material. Furthermore, the cleaning device 10 can be adapted to operate with any material reduction machine or any other machine having a sizing screen or filter capable of becoming obstructed.

What is claimed is:

1. A device for cleaning a screen in a material processing apparatus, said screen having at least a plurality of elongate bars defining spaces therebetween through which material flows, said device comprising:

rake means having a plurality of members for clearing material blocking said spaces; and a carriage assembly for guiding said rake means along the length of said elongate bars, said carriage assembly having two rails positioned parallel to and opposite each other on opposing sides of said screen, two wheels, each said wheel being oepratively connected to said rake means and being associated with a different one of said two rails so that said wheels are guided by said rails parallel to and opposite each other on opposing sides of said screen, and paired means for moving said wheels along said rails to provide matched drive actuation of said rake means so that said rake means moves along the length of said elongate bars in a manner which maintains said rake means in alignment with said screen.

2. A device as recited in claim 1 wherein said members are dimensioned to compliment the dimension of said spaces in such close tolerance to said elongate bars that said members clear material blocking said spaces when said carriage assembly is actuated without wearing said elongate bars.

3. A device as recited in claim 2 wherein said members are tines.

4. A device as recited in claim 1 wherein said members are brushes dimensioned to compliment the dimension of said spaces.

5. In a material reducing apparatus including a screen, said screen having a plurality of elongate parallel bars defining spaces therebetween through which reduced material flows, means adjacent to and downstream of said screen for clearing material from said spaces, said clearing means having a plurality of members dimensioned to extend into and operatively complement the dimension of said spaces the improvement comprising:

a carriage assembly for moving said members in said spaces along the length of said bars, said carriage assembly having two rails positioned parallel to and opposite each other on opposing sides of said screen, two wheels, each said wheel being operatively connected to said clearing means and being associated with a different one of said two rails so that said wheels are guided by said rails parallel to and opposite each other on opposing sides of said screen, and paired means for moving said wheels along said rails to provide matched drive actuation of said clearing means so that said clearing means moves along the length of said elongate bars in a manner which maintains said members of said clearing means in alignment with said spaces.

6. The improvement as recited in claim 5 wherein said clearing means is a rake and said members are tines.

7. The improvement as recited in claim 5 wherein said members extend through said spaces to clear material blocking said spaces on the upstream side of said screen.

8. The improvement as recited in claim 5 wherein said moving means is a fluid powered cylinder operatively connected to a driving arm, and said driving arm operatively connects said wheel to said clearing means.

* * * * *